US007794264B2

(12) United States Patent
Muncy et al.

(10) Patent No.: US 7,794,264 B2
(45) Date of Patent: Sep. 14, 2010

(54) HIGH DEFINITION MULTIMEDIA INTERFACE CONNECTOR RETENTION APPARATUS

(75) Inventors: Randall James Muncy, Wylie, TX (US); Robert James Paton, Plano, TX (US)

(73) Assignee: Cable Electronics, Inc., Garland, TX (US)

( * ) Notice: Subject to any disclaimer, the term of this patent is extended or adjusted under 35 U.S.C. 154(b) by 0 days.

(21) Appl. No.: 12/616,506

(22) Filed: Nov. 11, 2009

(65) Prior Publication Data

US 2010/0136820 A1 Jun. 3, 2010

Related U.S. Application Data

(63) Continuation of application No. 29/328,888, filed on Dec. 3, 2008, now Pat. No. Des. 607,306.

(51) Int. Cl.
*H01R 13/62* (2006.01)

(52) U.S. Cl. ..... 439/371

(58) Field of Classification Search ..... 439/371, 439/368; 174/65 R
See application file for complete search history.

(56) References Cited

U.S. PATENT DOCUMENTS 3,890,459 A * 6/1975 Caveney ..... 174/101
5,782,648 A * 7/1998 Peterson ..... 439/369
5,954,301 A * 9/1999 Joseph et al. ..... 248/68.1
6,033,251 A * 3/2000 Cook ..... 439/369
6,285,565 B1 * 9/2001 Åberg et al. ..... 361/826
6,554,646 B1 * 4/2003 Casey ..... 439/607.53
6,669,029 B1 * 12/2003 Beane ..... 211/26
7,140,903 B2 * 11/2006 Pulizzi et al. ..... 439/371
2001/0022231 A1 * 9/2001 Dyer ..... 174/48
2008/0011512 A1 * 1/2008 Burns ..... 174/504

* cited by examiner

*Primary Examiner*—Gary F. Paumen
(74) *Attorney, Agent, or Firm*—Haynes and Boone, LLP

(57) ABSTRACT

An apparatus for positioning and retaining an HDMI connector relative to an HDMI device comprises a body portion connected to the HDMI device and comprising a sidewall having an aperture through which a plug portion of the HDMI connector is insertable into a receptacle of the HDMI device and a bracket portion comprising a floor connected along a bottom edge of the sidewall and extending perpendicularly thereto. The bracket further comprises a support connected along an edge of the floor opposite the sidewall and extending upwardly from and perpendicularly to the floor and a fin connected along an edge of the support opposite the floor and extending perpendicularly to the support, the fin including a pair of openings disposed therethrough, the pair of openings corresponding to the aperture. Means are provided for securing a cable portion of the HDMI connector to the fin via the pair of openings when the plug portion is secured in the receptacle.

20 Claims, 4 Drawing Sheets

HIGH DEFINITION MULTIMEDIA INTERFACE CONNECTOR RETENTION APPARATUS

PRIORITY CLAIM UNDER 35 U.S.C. §120

This application is a continuation and claims the benefit of U.S. Design patent application No. 29/328,888 entitled HIGH DEFINITION MULTIMEDIA INTERFACE CONNECTOR RETENTION APPARATUS, filed on Dec. 3, 2008.

BACKGROUND

The present disclosure relates generally to high-definition multimedia interface ("HDMI") connectors and, more particularly, to a retention apparatus for securing such connectors relative to an HDMI device.

HDMI specifies an all-digital delivery interface for audio, video, and control signals. HDMI evolved from digital video interface ("DVI"), which was a digital video-only solution. DVI specifications required a relatively large, positively locking (via two screws) connector. In contrast, HDMI specifications require a smaller, more consumer-oriented connector that is secured via a friction lock. This inherently causes problems in retail, as well as other, environments, as HDMI cables can and routinely do come unplugged from the devices to which they are connected. The physical nature of the HDMI connector itself also leaves it vulnerable to breakage when excessive vertical force is applied to the connector when it is inserted into a device.

Therefore what is needed is a means by which to secure an HDMI connector to an HDMI device to prevent the connector from accidentally being disconnected from the device and to reduce the likelihood that the connector will be broken as a result of improper force applied to the connector or cable.

SUMMARY

An apparatus for positioning and retaining a high definition multimedia interface ("HDMI") connector relative to an HDMI device is disclosed. In one embodiment, the apparatus comprises a body portion connected to the HDMI device, the body portion comprising a sidewall having disposed therethrough an aperture through which a plug portion of the HDMI connector can be inserted into a receptacle of the HDMI device and a bracket portion comprising a floor connected along a bottom edge of the sidewall and extending perpendicularly thereto. The bracket further comprises a support connected along an edge of the floor opposite the sidewall and extending upwardly from and perpendicularly to the floor; and a fin connected along an edge of the support opposite the floor and extending perpendicularly to the support, the fin including a pair of openings disposed therethrough, the pair of openings corresponding to the aperture. The apparatus further comprises means for securing a cable portion of the HDMI connector to the fin via the pair of openings when the plug portion is secured in the receptacle.

DETAILED DESCRIPTION

Figure 1:
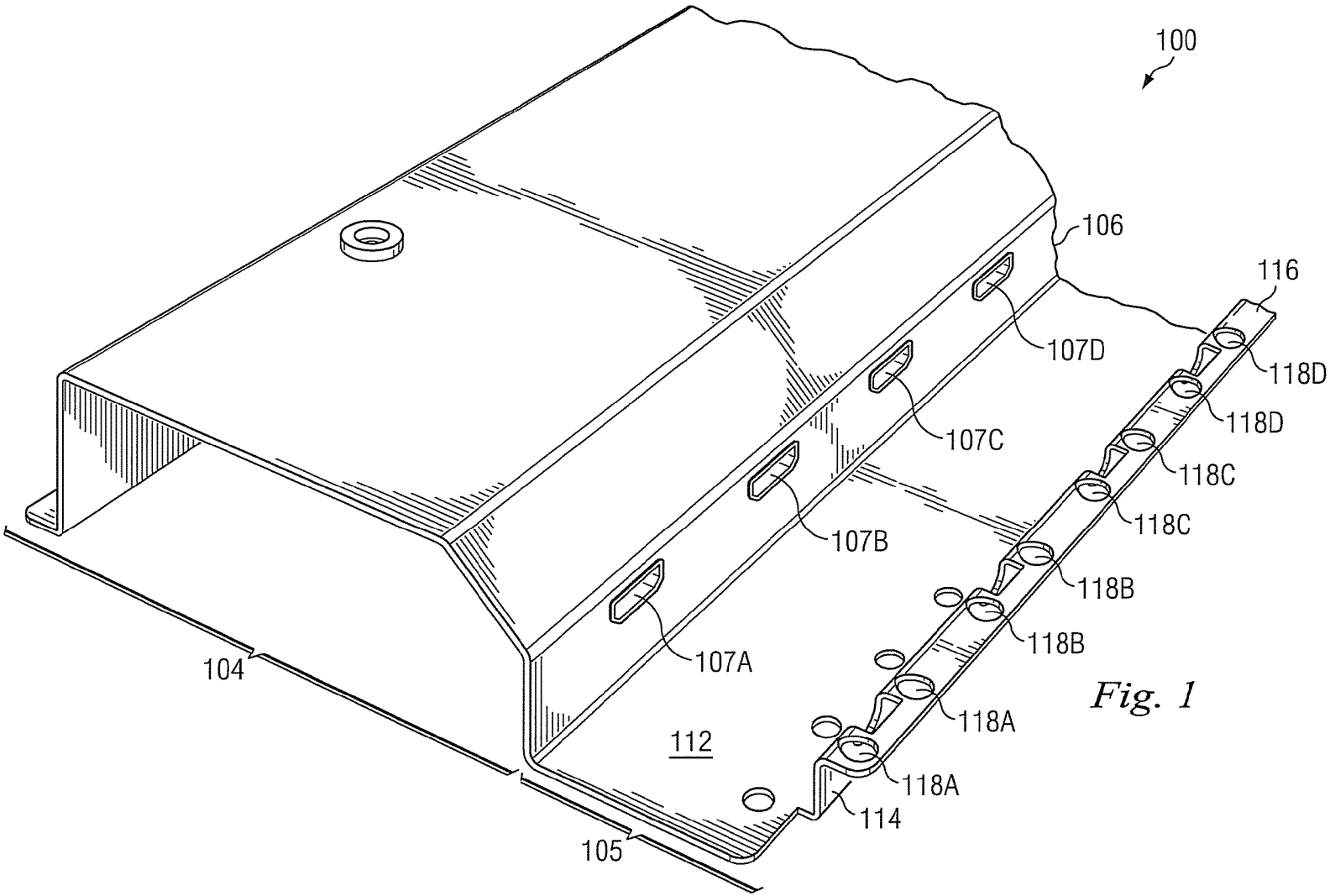
FIG. 1 is a perspective view of a portion of an HDMI connector retention apparatus in accordance with one embodiment.
Figure 2:
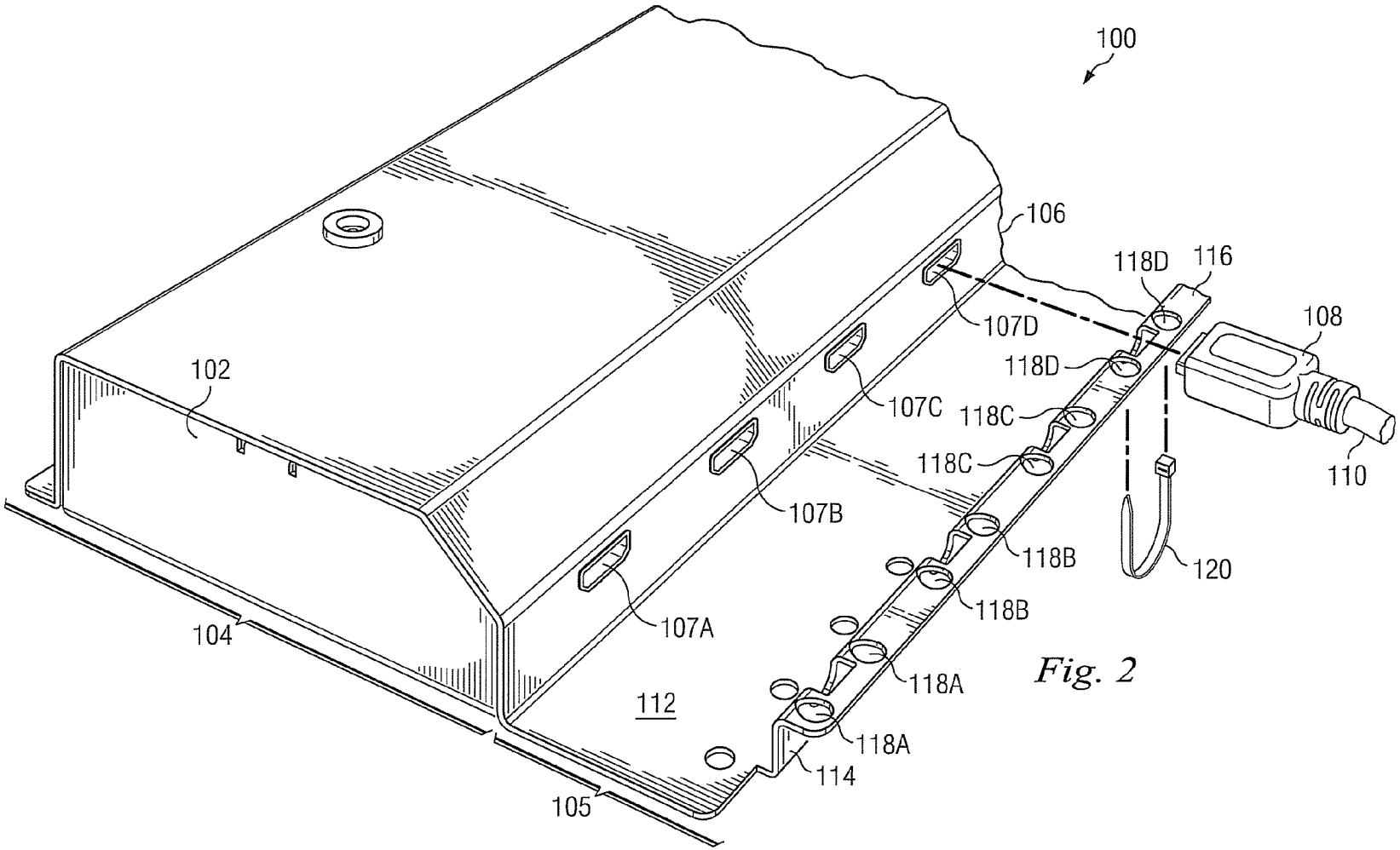
FIG. 2 is a perspective view of a portion of the HDMI connector retention apparatus of FIG. 1 attached to a chassis of an HDMI device in accordance with one embodiment.
Figure 3:
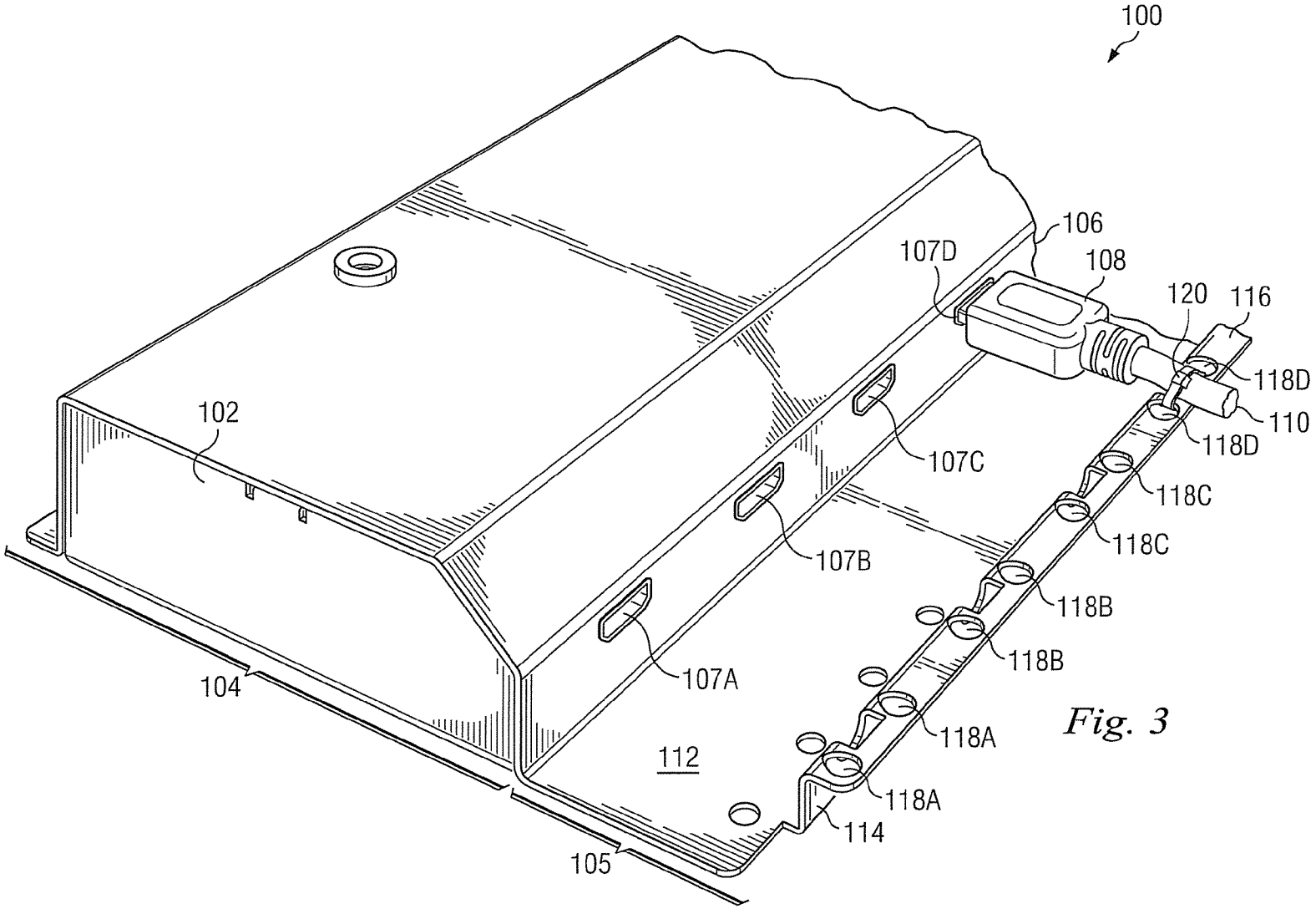
FIG. 3 is a perspective view of a portion of the HDMI connector retention apparatus of FIG. 2 in operation.

FIG. 1 illustrates an HDMI connector retention apparatus 100 in accordance with one embodiment. As illustrated in FIGS. 2 and 3, the HDMI connector retention apparatus 100 is designed to be removably attached to an HDMI device 102, e.g., via one or more screws (not shown). Referring again to FIG. 1, the apparatus 100 comprises a body portion 104 and a bracket portion 105 disposed along and projecting outwardly from a sidewall 106 of the body portion 104. As best illustrated in FIGS. 2 and 3, the sidewall 106 includes a plurality of apertures, such as apertures 107A-107D, each of which corresponds to a receptacle provided in the HDMI device 100 into which an HDMI plug 108 of an HDMI cable 110 may be inserted in a conventional manner.

The bracket portion 105 comprises a floor 112, which extends substantially perpendicularly to and along a bottom edge of the sidewall 106. The bracket portion 105 further includes a support 114, which is perpendicular to and extends upwardly from the floor 112 such that it is substantially parallel to the sidewall 106. A fin 116 extends outwardly from and perpendicular to the support 114 (and hence substantially parallel to the floor 112). The fin 116 includes a pair of openings 118A-118D corresponding to each aperture 107A-107D. As will be described in greater detail below, each pair of openings is located relative to the corresponding aperture such that when an HDMI plug is secured within the receptacle through the aperture, opposite ends of a cable tie may be inserted through the openings in the fin and used to secure the cable to the bracket portion. In particular, as best shown in FIG. 2, opposite ends of a cable tie 120 are inserted through the openings 118D and then the ends thereof are secured together around the cable 110 once the plug 108 is retained within the corresponding receptacle, as best shown in FIG. 3, such that the cable is secured to the fin 118. In the illustrated embodiment, the tie 120 comprises a cable tie, although it will be recognized that other means for bundling cable together securely and semi-permanently, such as cable lacing, binding knots, Velcro hook and loop straps, twist ties, or metal buckle clips, may be employed for this purpose.

In one embodiment, the apparatus 100 is constructed of steel that may be zinc- and/or black-powder coated; however, it will be recognized that other suitable materials may be used.

It will be recognized that, although in the embodiment illustrated herein, the retention apparatus 100 is independent of and removable from the chassis of the HDMI device 102, it is anticipated that in alternative embodiments, the retention apparatus may be integral to the chassis of the device. In another alternative embodiment of the retention apparatus, the apparatus may comprise only the bracket portion 105 thereof, with the bracket portion being secured directly to the HDMI device chassis in an appropriate manner, such as via one or more screws. In yet another alternative embodiment of the retention apparatus, the apparatus may comprise a combination of the bracket portion 105 and the sidewall 106 secured directly to the HDMI device in an appropriate manner, such as via one or more screws.

Figure 4:
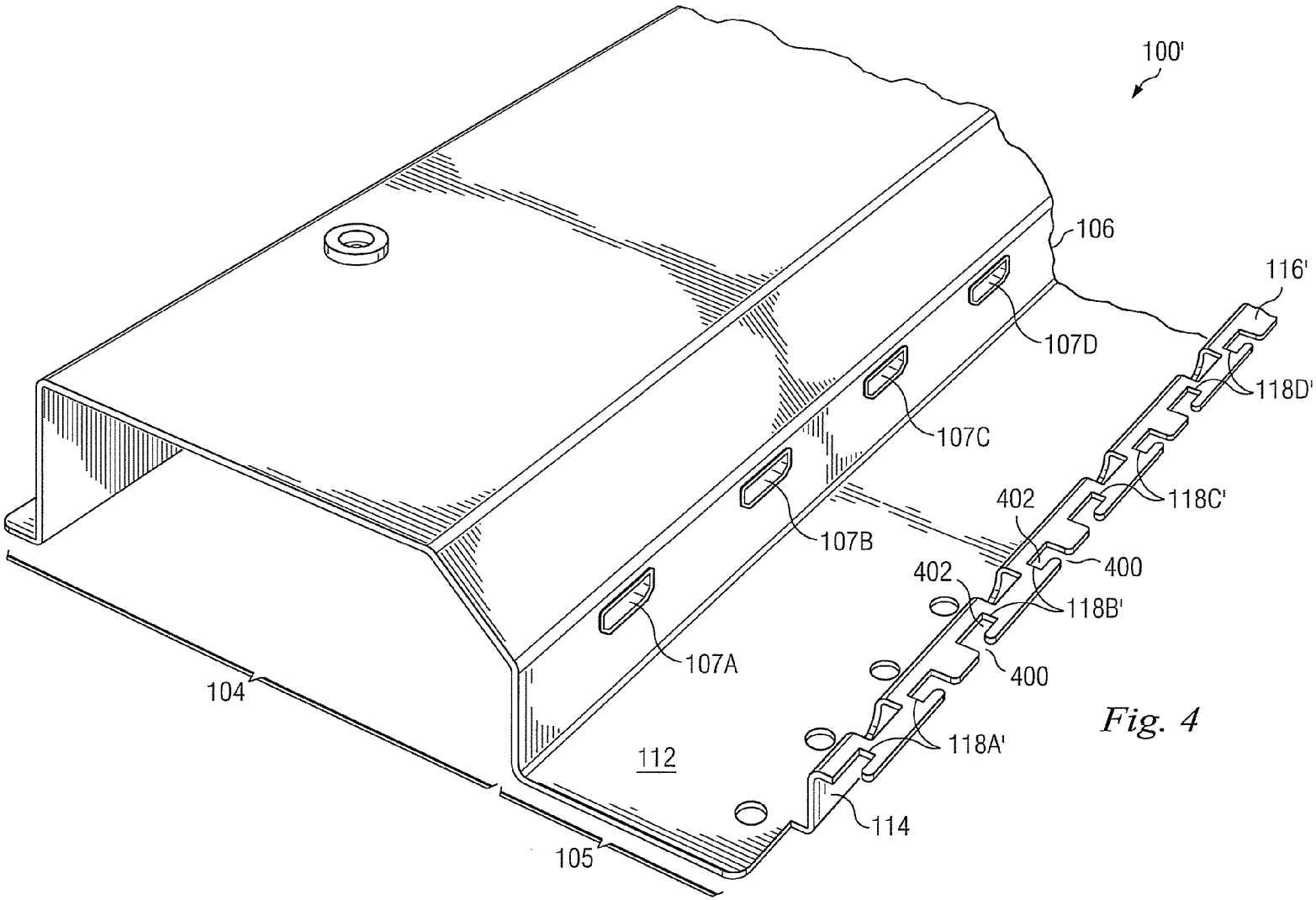
FIG. 4 is a perspective view of a portion of an HDMI connector retention apparatus in accordance with an alternative embodiment.

It will be noted that the pairs of openings 118A-118D illustrated in FIGS. 1-3 are substantially circular; however, it is not necessary for them to be so. FIG. 4 illustrates an HDMI connector retention apparatus 100' in accordance with an alternative embodiment. In particular, FIG. 4 illustrates an alternative design for the pairs of openings, designated in FIG. 4 by reference numerals 118A'-118D'. In the alternative opening design illustrated in FIG. 4, the each opening of each pair of openings 118A'-118D' is substantially rectangular and includes a slot, such as slots 400. In operation, a cable tie (not shown) may be passed through the slots 400 into a main body 402 of each of the openings to allow for easier insertion of the cable tie (not shown) into the openings for securing the cable (not shown) as described above.

It is understood that several modifications, changes and substitutions are intended in the foregoing disclosure and in some instances some features of the invention will be employed without a corresponding use of other features. Accordingly, it is appropriate that the appended claims be construed broadly and in a manner consistent with the scope of the embodiments described herein.

What is claimed is:

1. An apparatus for positioning and retaining a connector relative to an electronic device, the apparatus comprising:

a body portion connected to the device, the body portion comprising a sidewall having disposed therethrough an aperture through which a plug portion of the connector can be inserted into a receptacle of the electronic device;

a bracket portion comprising:

a floor connected along a bottom edge of the sidewall and extending perpendicularly thereto;

a support connected along an edge of the floor opposite the sidewall and extending upwardly from and perpendicularly to the floor; and a fin connected along an edge of the support opposite the floor and extending perpendicularly to the support, the fin including a pair of openings disposed therethrough, the pair of openings corresponding to the aperture; and means for securing a cable portion of the connector to the fin via the pair of openings when the plug portion is secured in the receptacle.

2. The apparatus of claim 1 wherein the means for securing comprises a cable tie, wherein one end of the cable tie is inserted through a first opening of the pair of openings and the other end of the cable tie is inserted through a second opening of the pair of openings and the ends are secured together around the cable.

3. The apparatus of claim 1 wherein the body portion is integrated into a chassis of the electronic device.

4. The apparatus of claim 1 wherein the body portion is removably connected to a chassis of the electronic device.

5. The apparatus of claim 1 wherein the openings are substantially circular in shape.

6. The apparatus of claim 1 wherein each of the openings includes a slot for enabling the cable tie to be passed therethrough from an outer edge of the fin into a main body of the opening.

7. The apparatus of claim 1 wherein the body portion encases a substantial portion of an upper surface of the electronic device.

8. The apparatus of claim 1 wherein the bracket portion comprises coated steel.

9. The apparatus of claim 1 wherein the means for securing comprises a mechanism selected from the group consisting of cable lacing, binding knots, Velcro hook and loop straps, twist ties, and metal buckle clips.

10. The apparatus of claim 1 wherein the electronic device is a high definition multimedia interface ("HDMI") device and the connector is an HDMI connector.

11. An apparatus for positioning and retaining a connector relative to an electronic device, the apparatus comprising:

a bracket portion comprising:

a floor connected along a bottom edge of a sidewall of the electronic device and extending perpendicularly thereto, wherein the sidewall of the electronic device includes an aperture through which a plug portion of the connector can be inserted into a receptacle of the electronic device;

a support connected along an edge of the floor opposite the sidewall and extending upwardly from and perpendicularly to the floor; and a fin connected along an edge of the support opposite the floor and extending perpendicularly to the support, the fin including a pair of openings disposed therethrough, the pair of openings corresponding to the aperture; and means for securing a cable portion of the connector to the fin via the pair of openings when the plug portion is secured in the receptacle.

12. The apparatus of claim 11 wherein the means for securing comprises a cable tie, wherein one end of the cable tie is inserted through a first opening of the pair of openings and the other end of the cable tie is inserted through a second opening of the pair of openings and the ends are secured together around the cable.

13. The apparatus of claim 11 wherein the bracket portion is integrated into a chassis of the electronic device.

14. The apparatus of claim 11 wherein the bracket portion is removably connected to a chassis of the electronic device.

15. The apparatus of claim 11 wherein the openings are substantially circular in shape.

16. The apparatus of claim 11 wherein each of the openings includes a slot for enabling the cable tie to be passed therethrough from an outer edge of the fin into a main body of the opening.

17. The apparatus of claim 11 wherein the means for securing comprises a mechanism selected from the group consisting of cable lacing, binding knots, Velcro hook and loop straps, twist ties, and metal buckle clips.

18. An apparatus for positioning and retaining a connector relative to an electronic device, the apparatus being integral with a chassis of the device and comprising:

a bracket portion comprising:

a floor connected along a bottom edge of a sidewall of the electronic device and extending perpendicularly thereto, wherein the sidewall of the electronic device includes an aperture through which a plug portion of the connector can be inserted into a receptacle of the electronic device;

a support connected along an edge of the floor opposite the sidewall and extending upwardly from and perpendicularly to the floor; and a fin connected along an edge of the support opposite the floor and extending perpendicularly to the support, the fin including a pair of openings disposed therethrough, the pair of openings corresponding to the aperture; and means for securing a cable portion of the connector to the fin via the pair of openings when the plug portion is secured in the receptacle.

19. The apparatus of claim 18 wherein the means for securing comprises a cable tie, wherein one end of the cable tie is inserted through a first opening of the pair of openings and the other end of the cable tie is inserted through a second opening of the pair of openings and the ends are secured together around the cable.

20. The apparatus of claim 18 wherein the electronic device is a high definition multimedia interface ("HDMI") device and the connector is an HDMI connector.

* * * * *